US008918026B2

(12) United States Patent
Shimomura

(10) Patent No.: US 8,918,026 B2
(45) Date of Patent: Dec. 23, 2014

(54) DEVELOPER HOLDING APPARATUS, DEVELOPING UNIT THAT INCORPORATES THE DEVELOPER HOLDING APPARATUS, AND IMAGE FORMING APPARATUS THAT EMPLOYS THE DEVELOPER HOLDING APPARATUS

(75) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 226 days.

(21) Appl. No.: 13/536,961

(22) Filed: Jun. 28, 2012

(65) Prior Publication Data

US 2013/0004208 A1 Jan. 3, 2013

(30) Foreign Application Priority Data

Jul. 1, 2011 (JP) ..... 2011-147338

(51) Int. Cl.
*G03G 15/08* (2006.01)

(52) U.S. Cl.
CPC ..... *G03G 15/0889* (2013.01)
USPC ..... 399/256

(58) Field of Classification Search
CPC ..... G03G 15/0889
USPC ..... 399/256, 263; 366/325.4, 325.5, 325.9, 366/313, 325.6, 325.7, 325.8, 325.91, 366/328.1, 328.2, 328.3, 328.4, 329.1, 343, 366/325.94
See application file for complete search history.

(56) References Cited

U.S. PATENT DOCUMENTS 5,331,388 A * 7/1994 Marotta et al. ..... 399/263
5,424,816 A * 6/1995 Fox et al. ..... 399/263
5,436,704 A 7/1995 Moon
5,572,301 A * 11/1996 Shiratori ..... 399/263
6,115,567 A * 9/2000 Kawai et al. ..... 399/263
6,131,007 A * 10/2000 Yamaguchi et al. ..... 399/256
7,272,346 B2 * 9/2007 Ito ..... 399/263
7,483,656 B2 * 1/2009 Park ..... 399/263
2005/0041996 A1 * 2/2005 Kishigami
2005/0117919 A1 * 6/2005 Ito et al.
2006/0051110 A1 * 3/2006 Koyama
2008/0181627 A1 * 7/2008 Bae ..... 399/263
2009/0185833 A1 * 7/2009 Shimomura ..... 399/263
2012/0328307 A1 * 12/2012 Oda et al. ..... 399/263

FOREIGN PATENT DOCUMENTS

EP 1184740 A2 * 3/2002
JP 58009173 A * 1/1983
JP 11038744 A * 2/1999
JP 2001-305846 11/2001
JP 2006-023537 A 1/2006
JP 2006023537 A * 1/2006
JP 2008292796 A * 12/2008

* cited by examiner

*Primary Examiner* — Susan Lee
(74) *Attorney, Agent, or Firm* — Rabin & Berdo, P.C.

(57) ABSTRACT

A developer holding apparatus holds a developer material therein. A rotatable member is disposed within the developer holding apparatus. The rotatable member includes a rotational shaft and an agitating portion. The agitator is offset relative to the rotational shaft and extends in a first direction parallel to the rotational shaft. The agitating portion includes a first portion and a second portion. The first portion includes a first dimension in a second direction substantially perpendicular to the first direction and the second portion includes a second dimension in a third direction substantially parallel to the second direction. The second dimension is smaller in width than first dimension.

12 Claims, 12 Drawing Sheets

DEVELOPER HOLDING APPARATUS, DEVELOPING UNIT THAT INCORPORATES THE DEVELOPER HOLDING APPARATUS, AND IMAGE FORMING APPARATUS THAT EMPLOYS THE DEVELOPER HOLDING APPARATUS

BACKGROUND OF THE INVENTION

1. Field of the Invention

The present invention relates to a developer holding apparatus that incorporates a toner level detecting mechanism, the toner detecting mechanism detecting a remaining amount of toner in the developer holding apparatus. The present invention also relates to a developing unit that incorporates the developer holding apparatus and an image forming apparatus that incorporates the developing holding apparatus.

2. Description of the Related Art

One type of toner level detector is disclosed in, for example, Japanese patent publication No. 2006-23537. The toner level detector is disposed in a toner reservoir in a developing unit, and employs a toner agitator that rotates to agitate the toner. The amount of toner remaining in the toner reservoir is detected based on the rotation of the toner agitator. The agitator has a crank portion that agitates the toner. The agitator is rotated by a drive shaft until the crank portion reaches its top dead center TDC. The crank portion then falls by gravity to land on the pile of the toner.

The aforementioned toner detector detects the toner level based on various items of information when the crank portion of the agitator falls by gravity to land on the pile of the toner. Therefore, it is important for the agitator to accurately land on the surface of the toner without sinking into the pile of toner significantly. However, due to the fluidity of toner and conditions when the crank portion falls by gravity from the top dead center, the crank portion may sink into the pile of toner, causing errors in detecting the amount of toner remaining in the reservoir. Therefore, it was difficult for the conventional toner detector to accurately detect the amount of toner remaining in the toner reservoir.

SUMMARY OF THE INVENTION

An aspect of the invention is that a developing unit is capable of accurately detecting a toner level in a toner reservoir.

A developer holding apparatus holds a developer material therein. A rotatable member (27, 127) is disposed within the developer holding apparatus. The rotatable member includes a rotational shaft (27*b*, 127*b*) and an agitating portion (27*e*, 127*e*). The agitator is offset relative to the rotational shaft and extends in a first direction parallel to the rotational shaft. The agitating portion includes a first portion (27*e*, 127*e*) and a second portion (27*f*, 127*f*). The first portion includes a first dimension (W1, D2) in a second direction substantially perpendicular to the first direction and the second portion (27*f*, 127*f*) includes a second dimension (D1, D3) in a third direction substantially parallel to the second direction. The second dimension is smaller in width than first dimension.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the present invention will be described with respect to a developing unit that employs a toner agitator. It is to be noted that the present invention may be applicable to a developer holding apparatus such as a toner cartridge.

First Embodiment

Figure 1:
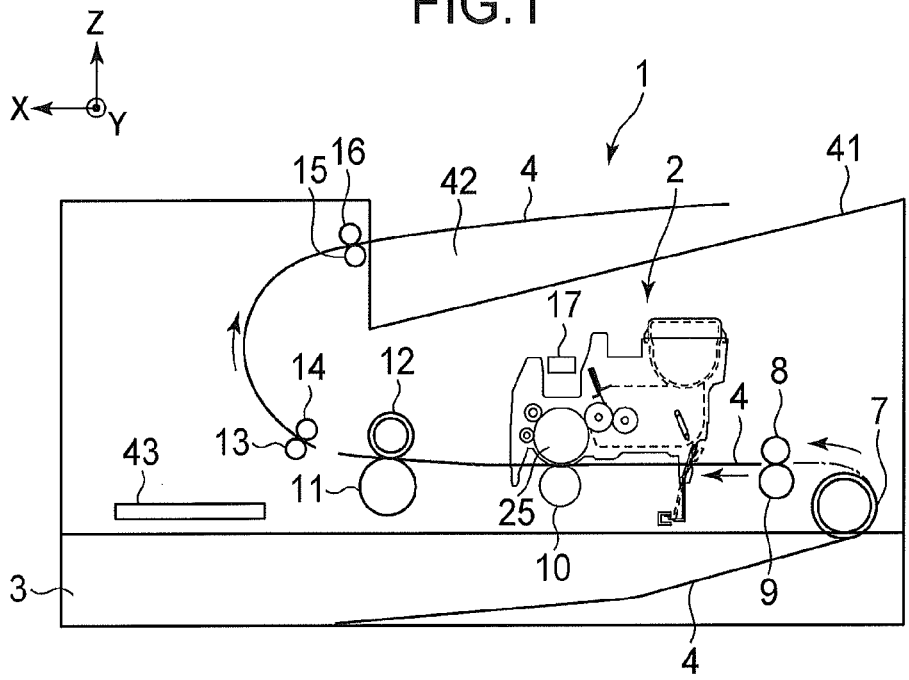
FIG. 1 illustrates the general configuration of an image forming apparatus.

FIG. 1 illustrates the general configuration of an image forming apparatus 1 that employs a developing unit according to the present invention.

The image forming apparatus 1 is an electrophotographic printer capable of printing an image using a black (K) toner. The image forming apparatus 1 includes a transport path along which registry rollers 8 and 9 and discharge rollers 13-16 are disposed. A paper cassette 3 holds a stack of recording paper 4 and is disposed most upstream of the transport path. A stacker 42 is formed on a cover 41 and is located most downstream of the transport path.

A hopping roller 7 feeds the recording paper 4 from the paper cassette 3 on a sheet-by-sheet basis into the transport path. The registry rollers 8 and 9 are located downstream of the hopping roller 7 and corrects skew of the recording paper 4 before advancing the recording paper 4 into a developing unit 2 at a predetermined timing. The developing unit 2 is disposed downstream of the registry rollers 8 and 9, and includes a photoconductive drum 25 on which a toner image is formed and a transfer roller that transfers the toner image onto the recording paper 4 when the recording paper 4 passes through a transfer point defined between the photoconductive drum and the transfer roller. A fixing unit includes a heat roller 12 and a back-up roller 11 and is disposed downstream of the developing unit 2. When the recording paper 4 passes through a fixing point defined between the heat roller 12 and back-up roller 11, the toner image on the recording paper 4 is fused into a permanent image by heat and pressure. The recording paper 4 is further transported by the discharge rollers 13-16 onto the stacker 42 outside of the image forming apparatus 1.

A control circuit board 43 is disposed in the image forming apparatus 1, and supports a control circuit built thereon. The control circuit controls the overall operation of the image forming apparatus 1.

The recording paper 4 is transported in a direction shown by arrow X. The photoconductive drum 25 rotates on a rotational axis which extends in a direction shown by arrow Y. A direction perpendicular to the X direction and Y direction is shown by arrow Z. The directions X, Y, and Z are used commonly throughout the drawings. It is to be noted that the Z direction is generally a gravitational direction.

Figure 2:
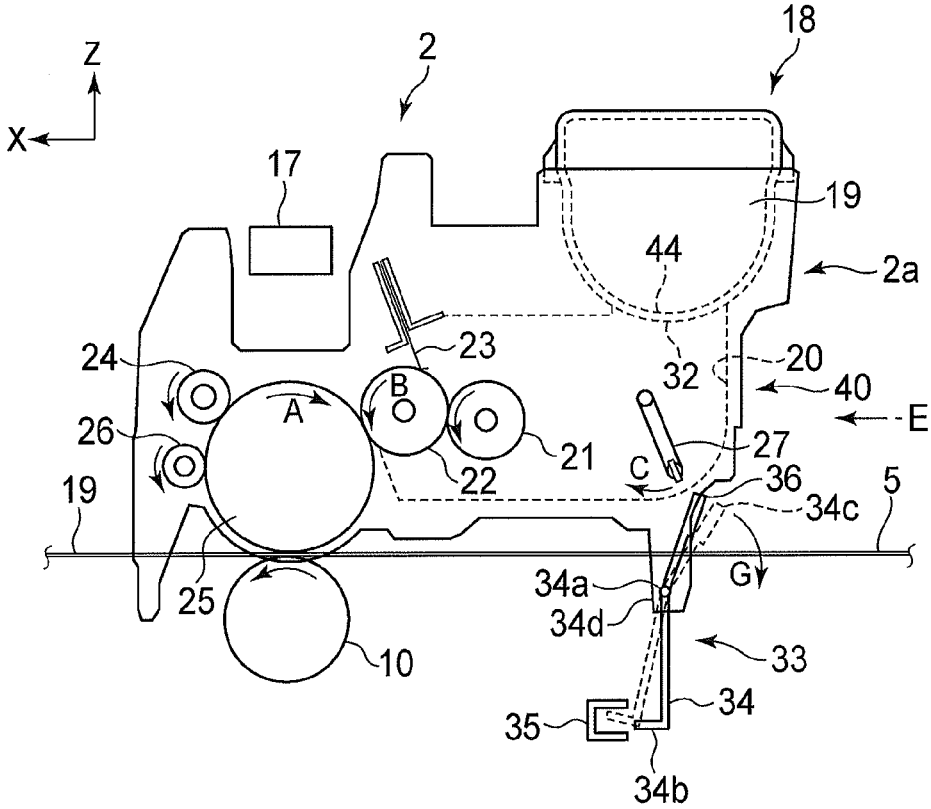
FIG. 2 illustrates a general configuration of the developing unit together with a transfer roller, an LED head, and recording paper.

FIG. 2 illustrates a general configuration of the developing unit 2 together with the transfer roller 10, an LED head 17, and the recording paper 4.

The developing unit 2 includes the photoconductive drum 25 supported such that the photoconductive drum 25 can rotate in a direction shown by arrow A. The photoconductive drum 25 is capable of holding charge thereon, which may be dissipated by irradiating with light to form an electrostatic latent image. Disposed around the photoconductive drum 25 are a charging roller 24, an LED head 17, a developing roller 22, a transfer roller 10, and a cleaning roller 26 in this order. The charging roller 24 rotates in pressure contact with the photoconductive drum 25 to uniformly charge the surface of the photoconductive drum 25. The LED head 17 illuminates the charged surface of the photoconductive drum 25 to form an electrostatic latent image on the surface of the photoconductive drum 25.

A developing roller 22 deposits the black toner to the electrostatic latent image. The transfer roller 10 transfers the toner image formed on the photoconductive drum 25 onto the recording paper 4. The cleaning roller 26 removes residual toner from the photoconductive drum 25 after transfer of the toner image.

The developing unit 40 includes a toner cartridge 18, a toner reservoir 20, an agitator 27, the developing roller 22, a toner supplying roller 21 and a developing blade 23. The toner cartridge 18 holds the toner therein and supplies the toner through a rectangular discharge opening 44 formed at its bottom. The toner reservoir 20 holds the toner supplied from the toner cartridge 18. The agitator 27 agitates the toner in the toner reservoir 20 and directs the toner to the supplying roller 21. The toner supplying roller 21 supplies the toner to the developing roller 22. The developing roller 22 rotates in contact with the photoconductor drum 25. The developing blade 23 forms a thin layer of toner on the developing roller 22. The developing roller 22 supplies the toner to the electrostatic latent image, thereby forming a visible image—hence a toner image. The toner cartridge 18 has a shutter that closes and opens the discharge opening 44 but FIG. 2 shows the toner cartridge 18 with its shutter omitted for simplicity.

The toner cartridge 18 is detachably attached on the upper portion of the toner reservoir 20. The toner reservoir 20 has a toner receiving opening 32 which substantially faces the discharge opening 44 of the toner cartridge 18. The toner reservoir 20 and the toner cartridge 18 may be integrally constructed.

A description will be given of how the drive force is transmitted to the respective mechanical members.

The photoconductive drum 25 has a drum gear (not shown) at a longitudinal end portion thereof. A drive force is transmitted through the drum gear from a drive source (not shown) of the image forming apparatus 1, so that the photoconductive drum 25 rotates in a direction shown by arrow A. The developing roller 22 has a gear (not shown) at a longitudinal end portion thereof through which the drive force is received from the drum gear, so that the developing roller 22 rotates in a direction shown by arrow B. The gear of the developing roller 22 is in mesh with that of the toner supplying roller 22 through an idle gear (not shown), so that the developing roller 22 and the toner supplying roller 21 rotate in the same direction. The rotation of the toner supplying roller 21 is then transmitted to a drive gear 28 (FIG. 4) of the agitator 27 via a gear train (not shown) so that the agitator 27 rotates in a direction shown by arrow C.

As shown in FIGS. 1 and 2, the transfer roller 10 is covered with, for example, an electrically conductive rubber, and parallels the photoconductive drum 25. A transfer belt (not shown) is held between the photoconductive drum 25 and the transfer roller 10 in a sandwiched relation. The transfer roller 10 receives a transfer voltage from a power supply. When the recording paper 4 passes through a contact area between the photoconductive drum and the transfer roller 10, the toner image is transferred from the photoconductive drum 25 onto the recording paper 4 by means of an electric field developed across the transfer roller 10 and the photoconductive drum 25.

When the recording paper 4 passes through the fixing point defined between the heat roller 12 and the back up roller 11, the fixing unit fixes the toner image (FIG. 2) carried on the recording paper 4.

The cover 35 is disposed on the top of the image forming apparatus 1, and can be opened and closed. The developing unit 2 is detachably attached to the image forming apparatus 1. The toner cartridge 18 is detachably attached to the developing unit 2.

A toner level detector uses the operation of the agitator 27. The operation of the agitator 27 will be described below.

Figure 3:
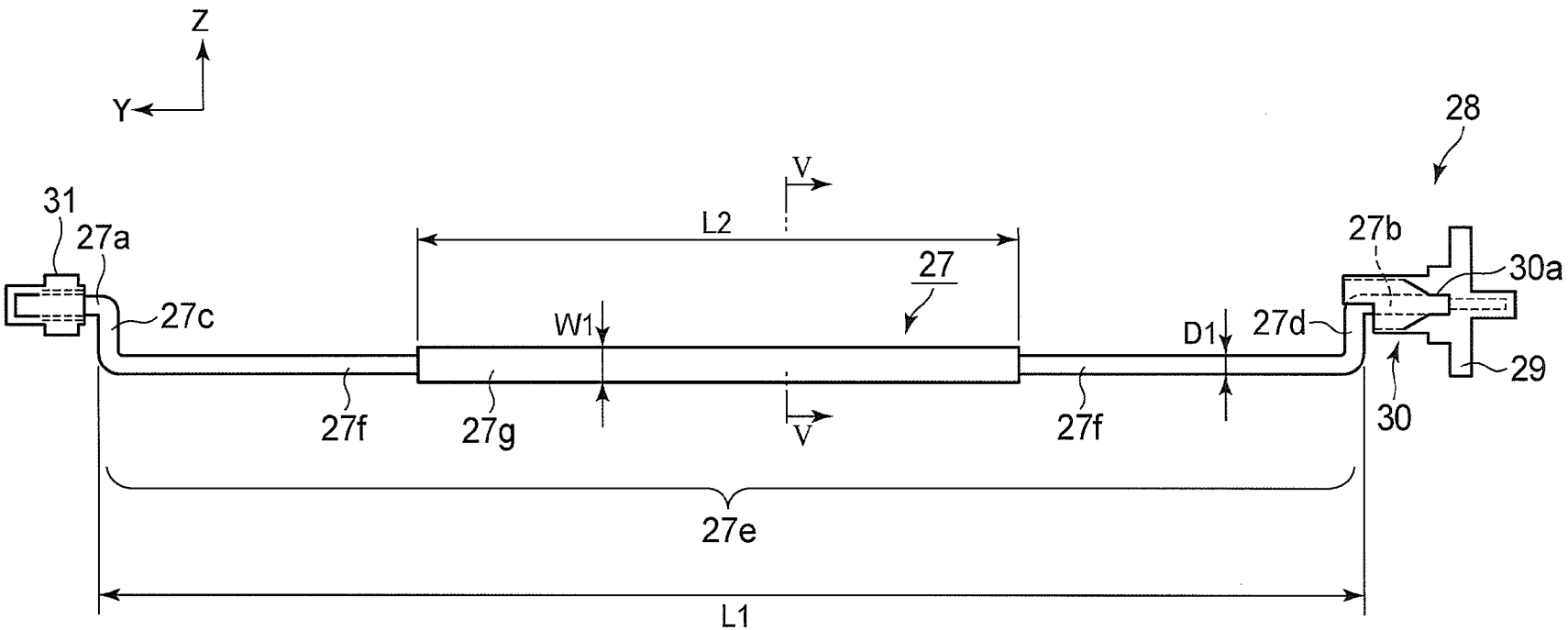
FIG. 3 is a side view of the agitator 27.
Figure 4A:
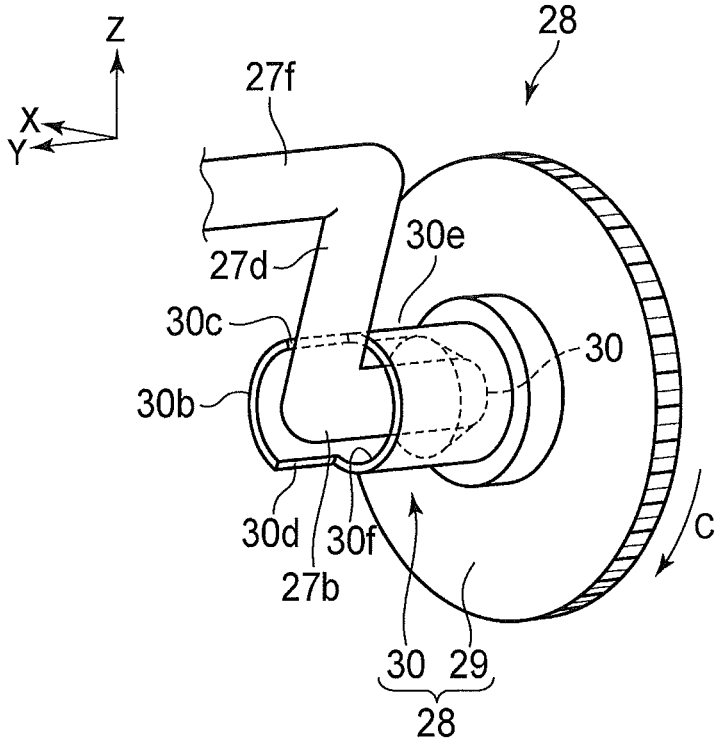
FIG. 4A is a partial perspective view of the drive gear 28 and agitator 27.
Figure 4B:
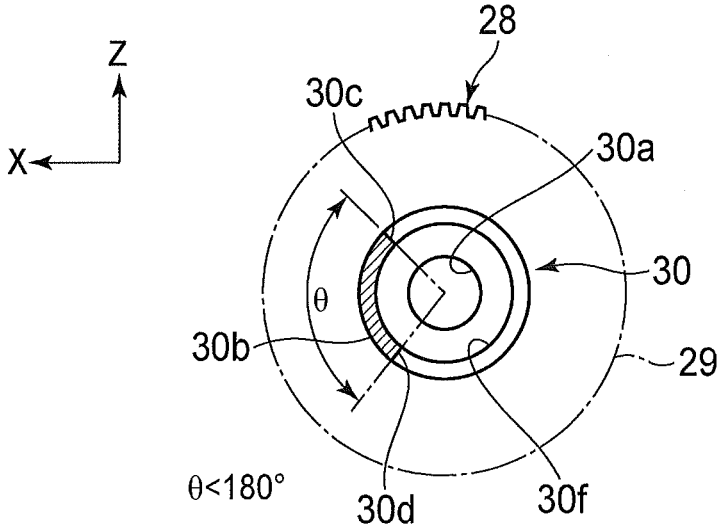
FIG. 4B is a side view illustrating the drive gear.
Figure 5A:
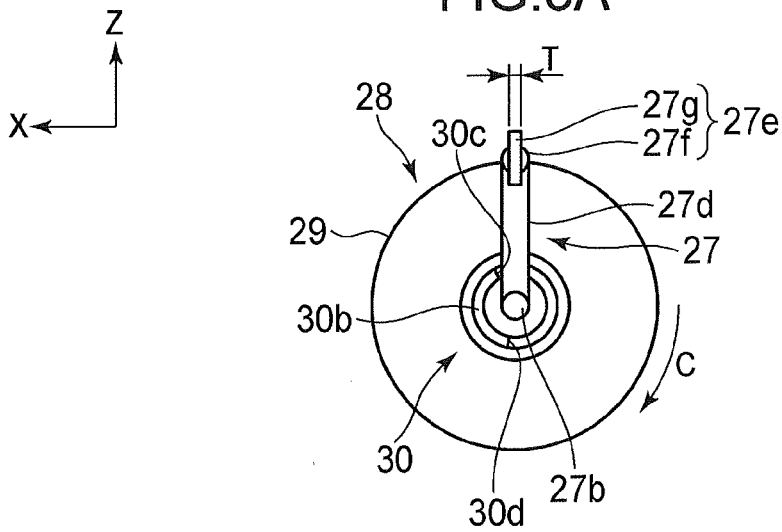
FIGS. 5A-5C are cross-sectional views taken along a line V-V in FIG. 3.
Figure 5B:
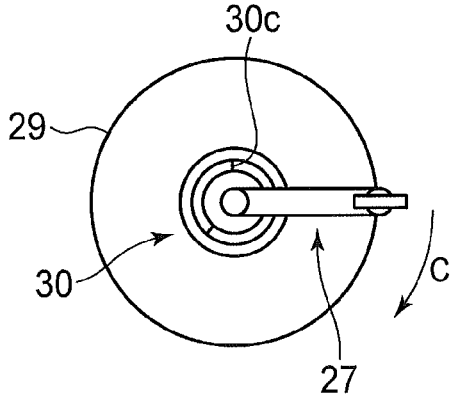
Figure 5C:
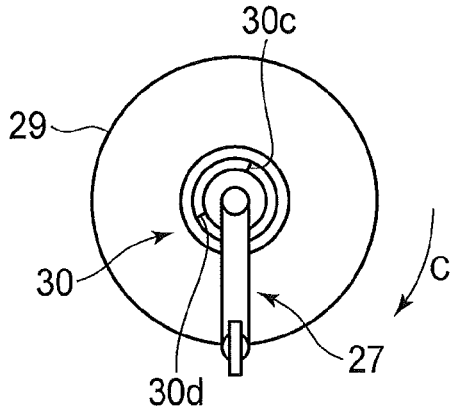

FIG. 3 is a side view of the agitator 27 as seen in a direction shown by arrow E (FIG. 2). FIG. 4A is a partial perspective view of the drive gear 28 and agitator 27 driven by the drive gear 28. FIG. 4B is a side view illustrating the drive gear 28. FIGS. 5A-5C are cross-sectional views taken along a line V-V in FIG. 3, and illustrate the operation of the agitator 27.

Referring to FIG. 3, the agitator 27 is in the shape of a crank, and is formed of, for example, a round bar of an iron-based metal material. The agitator 27 includes shaft portions 27*a* and 27*b*, arm portions 27*c* and 27*d*, and a crank pin or agitating portion 27*e*. The shaft portions 27*a* and 27*b* are in line with each other. The arm portions 27*c* and 27*d* extend in directions at an angle with the shaft portions 27*a* and 27*b*. The arm portions 27*c* and 27*d* extend in directions preferably substantially perpendicular to the shaft portions 27*a* and 27*b*. The agitating portion is offset relative to the shafts 27*a* and 27*b*. The agitating portion 27*e* agitates the toner 19 when the agitator 27 is driven in rotation. The agitating portion 27*e* has a length substantially equal to the length of the toner supplying roller 21, and parallels the toner supplying roller 21. The shaft 27*a* is rotatably received in a bearing 31 formed in the developing unit 2. Another shaft 27*b* is rotatably received by the drive gear 28 which will be described later. The shafts 27*a* and 27*b* and agitating portion 27*e* extend in parallel directions.

The agitating portion 27*e* extends in a longitudinal direction thereof and includes a round bar portion 27*f* having a circular cross-section and a flat plate portion 27*g* between the round bar portions 27*f*. The round bar portion 27*f* has its one longitudinal end connected to the arm portion 27*c* and the other longitudinal end connected to the arm portion 27*d*. The flat plate portion 27*g* is substantially at a longitudinally middle portion of the agitating portion 27*e*. The flat plate portion 27*g* is formed by, for example, crushing the middle portion of the agitating portion 27*e* as shown in FIG. 5, so that the flat plate portion 27*g* has a width larger than the diameter of the round bar portion 27*g*. In other words, the flat plate portion 27*g*, the round bar portions 27*f*, and the shaft 27*b* are in a single piece construction. For example, the round bar portion 27*f* has a diameter D of 2.2 mm and the flat plate portion 27*g* has a width W1 of 3.7 mm and a thickness T of 1.0 mm. The agitating portion 27*e* has an overall length L1 of 284 mm and the flat plate portion 27*g* has an overall length L2 of 99.5 mm. The longitudinal mid point of the flat plate portion 27*g* is substantially at the longitudinal mid point of the agitating portion 27*e*. The major surfaces of the flat plate portion generally lie in a plane in which the crank-shaped agitating member 27 lies. That is, the major surfaces of the flat plate portion generally lie in a plane parallel to the direction in which the arm portions 27*c* and 27*d* extend.

As shown in FIG. 4A, the drive gear 28 includes a gear 29 and a bearing 30. The gear 29 receives a drive force from the gear of the toner supplying roller 21 through a transmitting means. The bearing 30 is formed in a single piece construction with the gear 29 and supports the shaft 27*b* so that the shaft 27*b* is rotatable in the bearing 30. The bearing 30 includes a hollow cylinder 30*e* having a hole 30*a* and a hole 30*f* formed therein, and a partially-cylindrical wall 30*b* that axially extends from the hollow cylinder 30*e*. The hole 30*f* has a larger diameter than the hole 30*a*, so that when the shaft 27*b* is introduced into the bearing 30, the hole 30*f* guides the shaft 27*b* into the bearing 30 and is then rotatably received in the hole 30*a*. The partially cylindrical wall 30*b* extends circumferentially at an angle equal to or less than 180° from a side 30*d* to a side 30*c*. When the gear 28 rotates, the side 30*d* or 30*c* abuts the arm portion 27*d* depending on the direction of rotation, thereby transmitting the rotational force of the gear 28 to the agitating member 27.

A rotation detector 33 is disposed in the vicinity of the outer bottom surface of the developing unit 2, and detects the rotation of the agitating member 27. The rotation detector 33 includes a lever 34, a magnet 36, and a photo-coupler 35. The lever 34 includes a longitudinally extending upper portion and a longitudinally extending lower portion. The lever 34 includes a joint portion 34*a* where the upper portion and lower portion meet at their respective ends to form an angle less than 180°. The lever 34 is rockably supported on a pin 34*d* at the joint portion 34*a* of the upper portion and the lower portion. The upper portion has a longitudinal end portion 34*c*, opposite to the joint portion 34*a*, to which a magnet 36 is attached. The lower portion has an L-shaped end portion 34*b*. When the agitating portion 27*e* rotates, the agitating portion 27*e* approaches a vicinity of the magnet 36 so that the magnet 36 is magnetically attracted to the agitating portion 27*e*, opening the light path of the photo-coupler 35, and then leaves the vicinity so that the magnet 36 is released from the agitating portion 27*e*, closing the light path. Thus, every time the lever 34 makes one complete rotation, the lever 34 performs one complete rocking motion.

The weight of the combination of the upper portion and the magnet 36 is slightly larger than that of the lower portion, so that the lever 34 tends to rotate about the pin 34*d* in a direction shown by arrow G due to the gravitational force. Thus, when agitating portion 27*e* is sufficiently away from the vicinity of the magnet 36, the L-shaped portion is in the photo-coupler 35 and abuts the wall of the photo-coupler 35, closing the light path. When the magnet 36 is attracted to the agitating portion 27*e*, the lever 34 is at the solid line position shown in FIG. 2. When the magnet 36 is not attracted to the agitating portion 27*e*, the lever 34 is at the dotted line position. While the wall of the photo-coupler 35 serves as a stopper that prevents the agitating portion 27*e* from rocking, another stopper member may be employed instead.

The photo-coupler 35 generates a detection signal DETR representative of the amount of toner remaining in the toner reservoir.

A description will be given of the operation of the drive gear 28 and the agitator 27 when the toner reservoir 20 (FIG. 2) is empty of toner with reference to FIGS. 4A, 4B, and 5A-5C.

The drive gear 28 rotates in a direction shown by arrow C at a low speed in the range of 20 to 60 rpm. The side 30*c* of the partially cylindrical wall 30*b* pushes the arm 27*d* of the agitator 27. FIG. 5A illustrates when the agitator 27 has reached its top dead center TDC.

When the agitator 27 rotates past the top dead center TDC, the agitating portion 27*e* falls due to its weight while causing the agitator 27 to rotate freely. Since the partially cylindrical wall 30*b* extends circumferentially at angle equal to or less than 180°, the agitating portion 27*e* is allowed to rotate until the agitator 27 reaches the bottom dead center BDC. FIG. 5B illustrates the agitator 27 when it is rotating due to its weight. FIG. 5C illustrates the agitator 27 when it has reached the bottom dead center BDC. The agitator 27 stays at the bottom dead center until the gear 28 has rotated to an angular position where the partially cylindrical wall 30*b* again pushes the arm 27*d*. Once the partially cylindrical wall 30*b* reaches the arm 27*d*, the partially cylindrical wall 30*b* again pushes the arm 27*d* so that the agitator 27 can rotate together with the gear 28 until the agitating portion 27*e* rotates past the top dead center TDC.

Figure 6A:
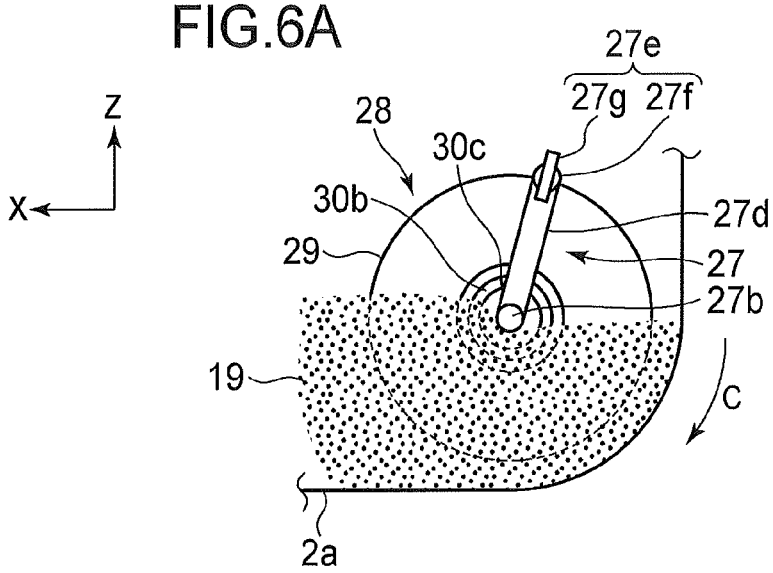
FIGS. 6A-6C illustrate the relation between the pile of toner and the position of the agitator.
Figure 6B:
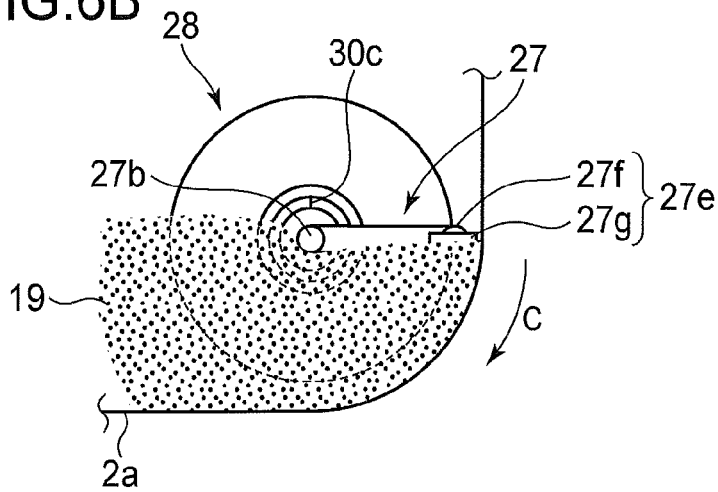
Figure 6C:
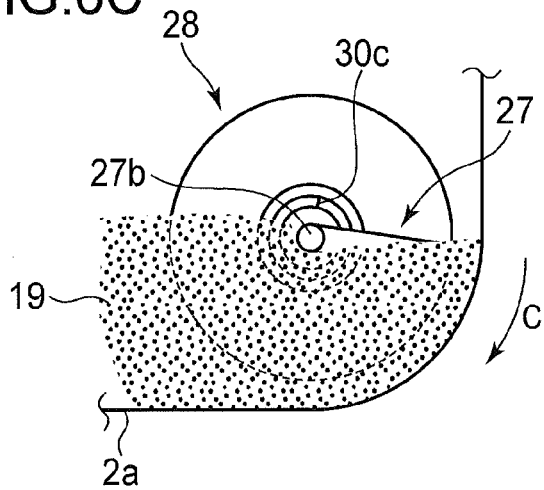

FIGS. 6A-6C illustrate the relation between the pile of toner 19 and the position of the agitator 27.

A description will be given of the operation of the drive gear 28 and the agitator 27 when the toner reservoir 20 (FIG. 2) is substantially full of toner with reference to FIGS. 6A, 6B, and 6C.

When the agitating portion 27*e* rotates past the top dead center TDC, the agitating portion 27*e* falls from the top dead center (FIG. 6A), and then lands on the surface of a pile of the toner 19 (FIG. 6B). While the pile of toner is in the form of a fluffy powder, since the major surface of the flat plate portion 27*g* is substantially parallel to the surface of the pile of the toner, the agitating portion 27*e* experiences a larger resistance than the round bar portions 27*f*, so that the agitating portion 27*e* will not significantly sink into the pile of the toner.

The gear 28 continues to rotate until the side 30*c* pushes the arm 27*d* again. The side 30*c* pushes the arm 27*d*, driving the agitator 27 to rotate together with the gear 28 while also agitating the toner 19. The agitator 27 continues to rotate until it rotates past the top dead center. In this manner, the agitator 27 repeats the aforementioned operation.

As described above, the agitating portion 27*e* will not significantly sink into the pile of the toner, and therefore the toner level in the toner reservoir 20 can be accurately detected based on the detection output of the photo-coupler 35.

Figure 13A:
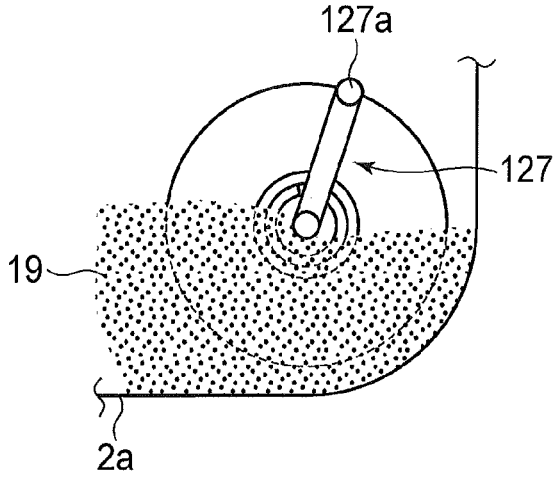
FIG.13A CONVENTIONAL ART
FIGS. 13A-13C illustrate the relation between the pile of toner and the position of the agitator according to a conventional art.
Figure 13B:
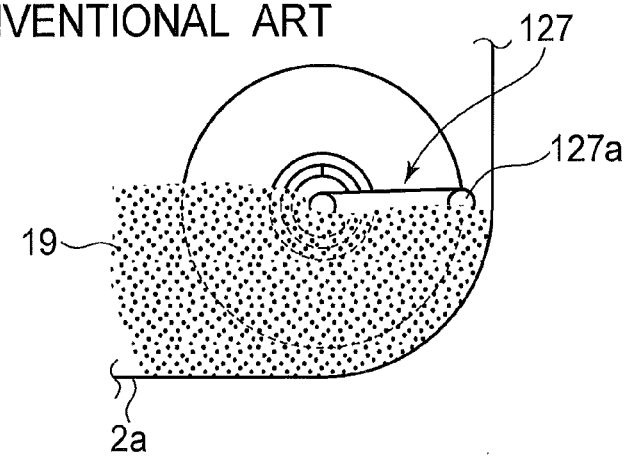
FIG.13B CONVENTIONAL ART
Figure 13C:
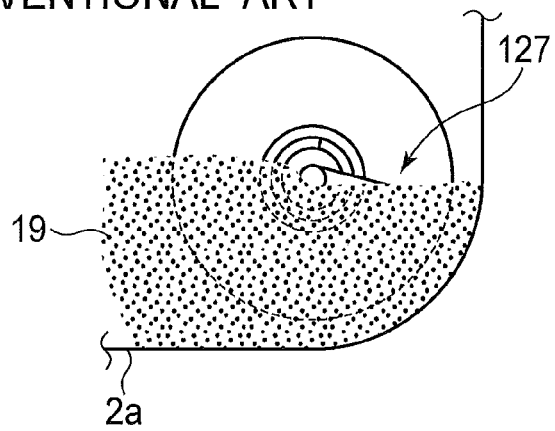
FIG.13C CONVENTIONAL ART

FIGS. 13A-13C illustrate the relation between the pile of toner and the position of the agitator according to a comparative example. With reference to FIGS. 13A-13C, a description will be given of the operation of the comparative example which does not employ the flat plate portion.

Figure 12A:
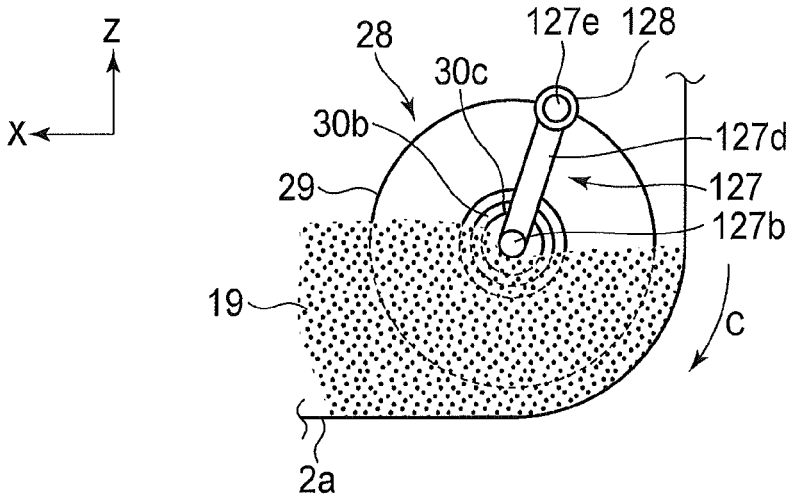
FIGS. 12A-12C illustrate the relation between the pile of toner and the position of the agitator according to a second embodiment.
Figure 12B:
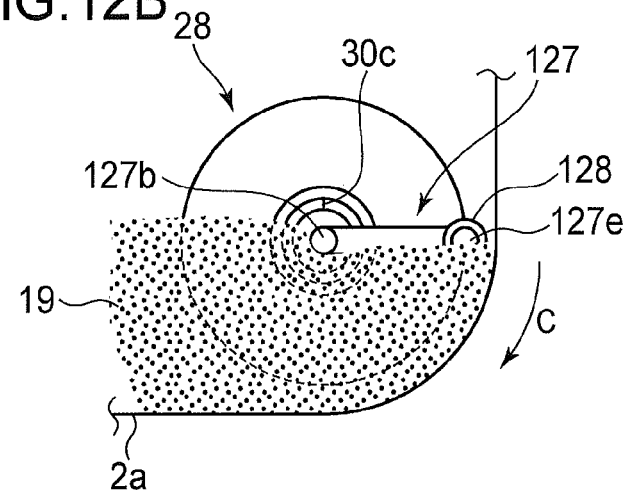
Figure 12C:
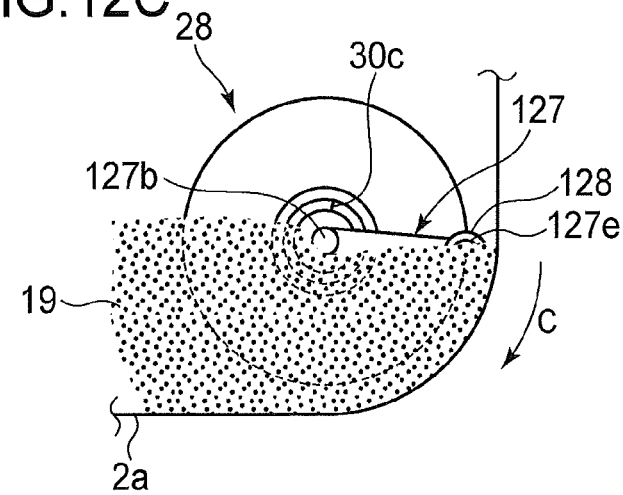

The agitating portion 127*a* begins to fall due to its weight after the agitator 127 has rotated past the top dead center TDC (FIG. 13A), and then the agitating portion 127*a* land on the surface of a pile of the toner 19 (FIG. 12B). Since the agitating portion 127*e* has not a flat plate portion, the agitating portion 127*e* will sink significantly into the pile of the toner 19 before it comes to rest (FIG. 12C).

In the toner reservoir 20, the toner 19 tends to pile more in the vicinity of the longitudinal end portions of the agitator 27 than in the longitudinally mid portion of the agitator 27. Thus, if the toner level in the toner reservoir 20 is detected based on the toner 19 remaining in the vicinity of the longitudinal end portions of the agitator 27, the detection signal tends to indicate that the toner reservoir 20 holds more toner than it actually does. As a result, printed images may become faint. In the present embodiment, the flat plate portion is not formed all across the agitating portion 27*e* but only a mid portion of the agitating portion 27*e*, so that the toner level in the vicinity of the longitudinally mid portion of the agitating portion 27*e* can be accurately detected.

A description will be given of a method for detecting, by means of the agitator 27, the amount of toner remaining in the toner reservoir 20 of the developing unit 2.

FIGS. 7A-7D and 8A-8D illustrate the operation for detecting the amount of toner remaining in the toner reservoir 20 when the toner reservoir 20 holds a large amount of the toner 19 and when the toner reservoir 20 holds only a small amount of the toner 19. FIGS. 7A-7D and 8A-8D shows cross-sections as seen in a Y direction. A small circle denotes the side 30*c* that pushes the arm 27*d*, driving the agitator 27 to rotate. When the agitating portion 27*e* passes through an angular range B in which the agitating portion 27*e* attracts the magnet 36, the photo-coupler 35 of the rotation detector 33 outputs the detection signal DETR of the Low level. When the agitating portion 27*e* passes the outside of the angular range B, the photo-coupler 35 outputs the detection signal DETR of the High level.

Figure 7A:
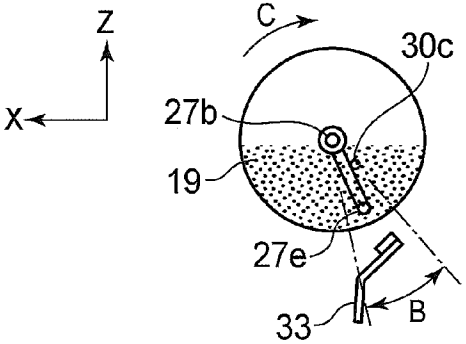
FIGS. 7A-7D and 8A-8D illustrate the operation for detecting the amount of toner remaining in the toner reservoir

Referring to FIGS. 7A-7D, the surface of the pile of toner is as high as the shaft 27*b*. In FIG. 7A, the agitating portion 27*e* is at the bottom dead center BDC and the side 30*c* is pushing the arm 27*d* so that the agitating portion 27*e* and the side 30*c* are rotating together in the C direction. When the agitating portion 27*e* is within the angular range B, the detection signal DETR is the Low level.

Figure 7B:
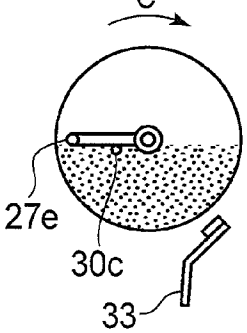
Figure 7C:
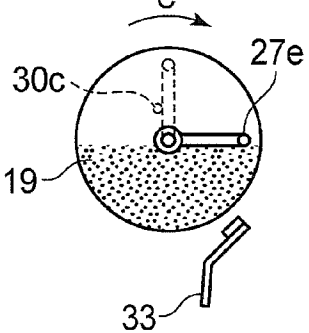
Figure 7D:
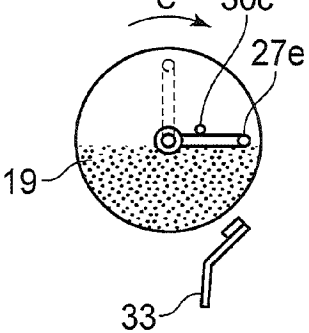

The agitating portion 27*e* then reaches a substantially horizontal plane in which the shaft 27*b* lies, and then moves out of the pile of the toner 19 (FIG. 7B). The agitating portion 27*e* then reaches the top dead center TDC, and further rotates past the top dead center TDC. Thus, the agitating portion 27*e* falls due to its weight, landing on the surface of the pile of the toner 19 (FIG. 7C).

The agitating portion 27*e* remains on the surface of the pile of the toner 19 until the side 30*c* pushes the arm 27*d* again. The side 30*c* eventually catches up the arm 27*d* and then begins to push the arm, driving the agitator 27 to rotate in the C direction. The operations shown in FIGS. 7A-7D are repeated as long as the gear 28 continues to rotate. When the agitating portion 27*e* passes through the angular range B, the photo-coupler outputs the detection signal DETR of the Low level.

Referring to FIGS. 8A-8D, the surface of the pile of the toner 19 is much lower than the shaft 27*b*, i.e., toner low condition. When the agitating portion 27*e* is at the bottom dead center BDC, the side 30*c* pushes the arm 27*d* as the gear 29 rotates in the C direction. The photo-coupler 35 outputs the detection signal DETR of the Low level.

Figure 8A:
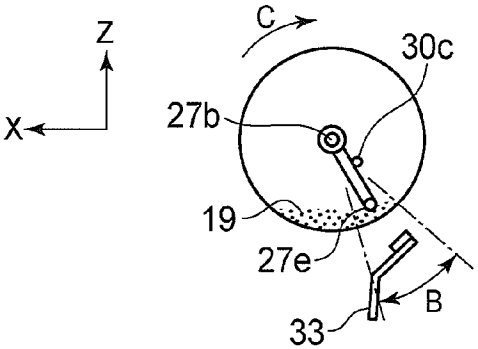
Figure 8B:
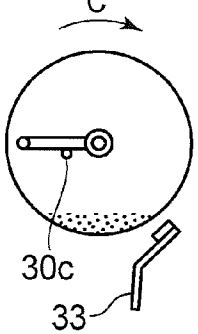
Figure 8C:
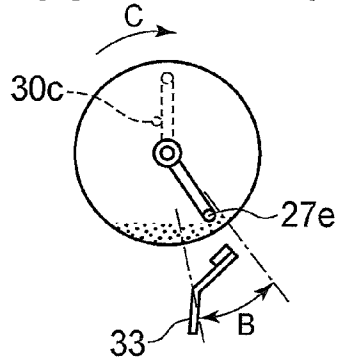

The agitating portion 27*e* then rotates through the horizontal plane in which the shaft 27*b* lies (FIG. 8A), reaching the top dead center TDC (FIG. 8C). When the agitating portion 27*e* rotates past the top dead center TDC, the agitating portion 27*e* falls due to its weight, landing on a small pile of the toner 19. The agitating portion 27*e* is detected by the rotation detector 33, so that the photo-coupler 35 outputs the detection signal DETR of the Low level.

Figure 8D:
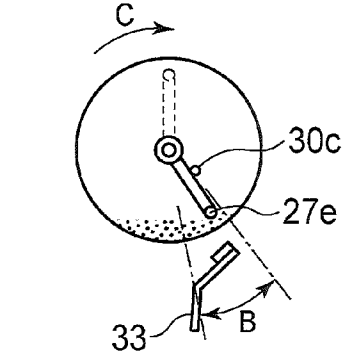

The agitating portion 27*e* remains at this angular position until the side 30*c* again pushes the arm 27*d* as shown in FIG. 8D, and the detection signal DETR remaining the Low level. Once the side 30*c* catches up the arm 27*d*, the side 30*c* pushes the arm 27*d* so that the agitating portion 27*e* and the side 30*c* rotate together in the C direction. The aforementioned operation is repeated as long as the gear 29 rotates.

As described above, the detection signal DETR clearly varies in duty cycle, i.e., High level duration and Low level duration, during one complete rotation of the agitator, depending on the angular range of motion of the agitating portion 27*e* where the side 30*c* pushes the arm 27*d*. When the toner reservoir 20 holds a large amount of toner, the Low level lasts a shorter time. When the toner reservoir 20 is almost empty of toner, the Low level lasts a longer time.

Figure 9A:
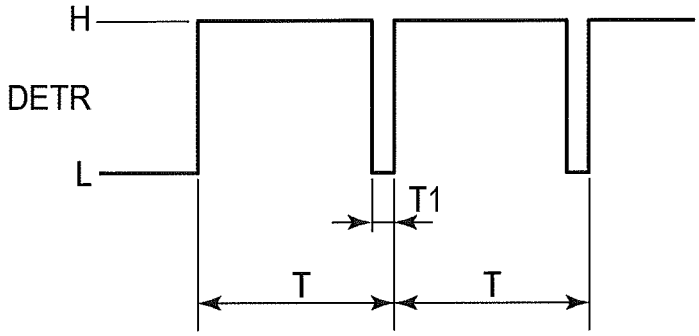
FIG. 9A illustrates the waveform of the detection signal when the toner reservoir holds the toner in excess of a predetermined amount or level.
Figure 9B:
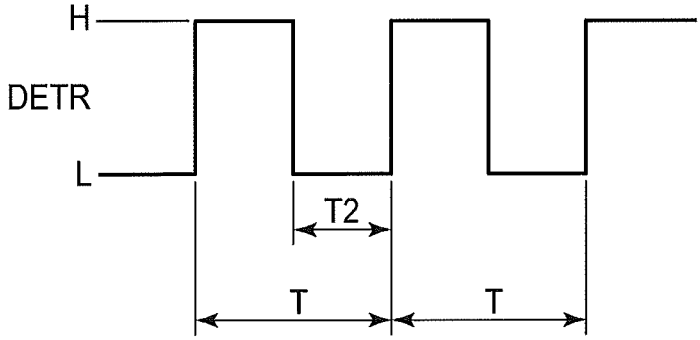
FIG. 9B illustrates the waveform of the detection signal when the toner reservoir holds the toner below the predetermined amount or level.

FIG. 9A illustrates the waveform of the detection signal DETR when the toner reservoir holds the toner 19 in excess of a predetermined amount or level. FIG. 9B illustrates the waveform of the detection signal DETR when the toner reservoir holds the toner 19 below the predetermined amount or level.

The period T is the time required for the agitator 27 or the gear 29 makes one complete rotation. When the toner reservoir 20 holds the toner 19 in excess of the predetermined amount, the time T1 is such that the agitating portion 27*e* is detected by the rotation detector 33 or the agitating portion 27*e* is within the angular range B. When the toner reservoir 20 holds the toner 19 below the predetermined amount, the time T2 is the time from when the agitating portion 27*e* falls from the top dead center TDC due to its weight until the side 30*c* catches up the agitating portion 27*e* remaining in the angular range B. Thus, the time T2>>T1.

Thus, the time during which the detection signal DETR is the Low level is compared with a reference time Ts. If the Low level DETR last longer than the reference time Ts, it can be determined that the remaining toner is below a predetermined amount.

As described above, the first embodiment makes use of the free fall of the agitating portion 27*e* from the top dead center of the agitating portion 27*e*, and the "toner low" is detected based on the fact that the duty cycle of the detection signal DETR, i.e., the ratio of the High level and the Low level, varies significantly depending on the amount of toner remaining in the toner reservoir 20. Alternatively, the "toner low" condition may be detected by the following method.

Figure 14:
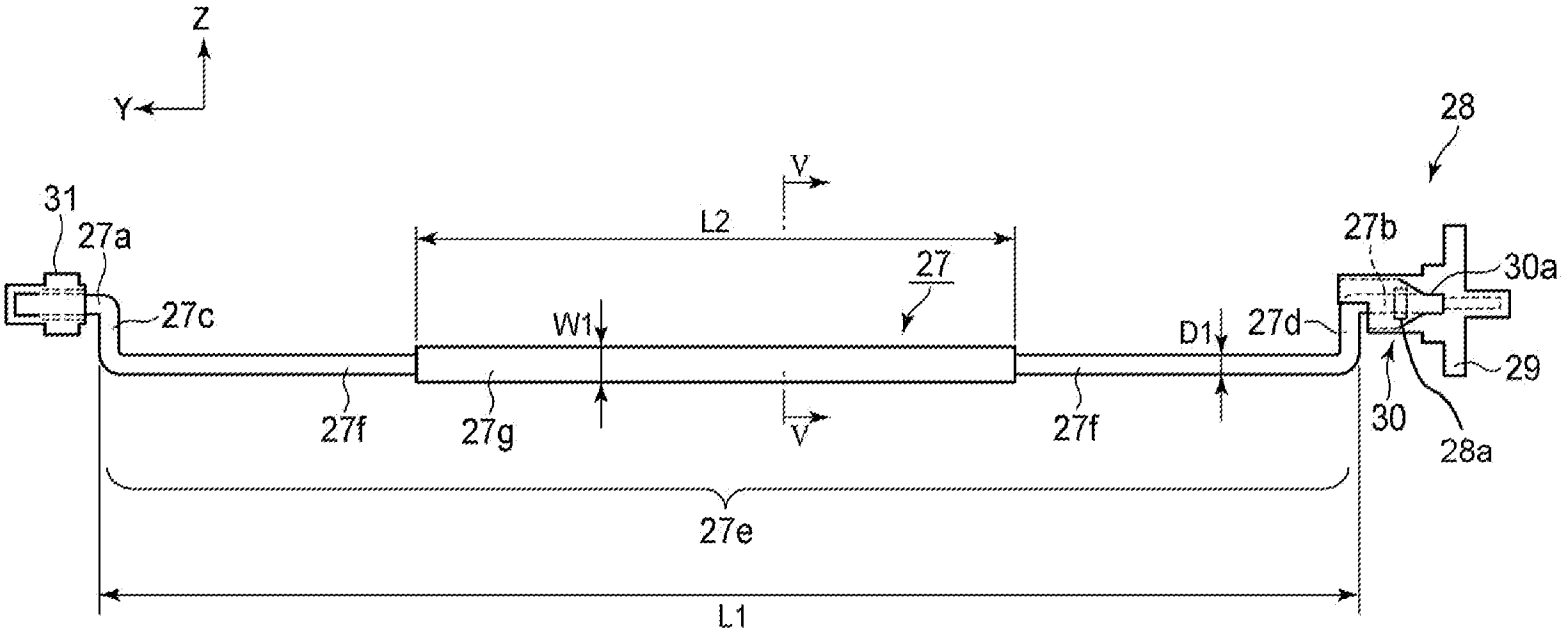
FIG. 14 is a side view of the agitator 27.

For example, the gear 28 and the agitator 27 shown in FIG. 4 may be coupled by means of a one-way clutch 28*a* shown in FIG. 14. As shown in FIG. 7C, the agitator 27 falls from the dotted line position (TDC) to the solid line position, and then the rotation of the gear 29 is transmitted to the agitator 27 in the C direction.

When the surface of the pile of the toner 19 is below the shaft 27*b*, the period T becomes shorter and therefore the "toner low" condition may be detected based on the period T.

In any one of the aforementioned methods, in order to accurately determine the amount of toner 19 remaining in the toner reservoir 20, the agitating portion is required to land on the pile of the toner without sinking the pile significantly.

Although the first embodiment has been described in terms of a crank pin having a flat plate portion that lies in a plane in which the agitator 27 lies, the agitating portion is not limited to this. For example, the flat plate portion may lie in a plane in which the surface of a pile of toner during the "toner low" condition, so that the toner low level can be accurately determined.

The dimensions W1, L1 and L2 shown in the first embodiment are only exemplary and these dimensions may be altered by experiment depending on the fluidity of the toner 19 and the shape of the toner reservoir 20.

As described above, when the agitator 27 falls by gravity from its top dead center TDC, the agitating portion 27*e* will land on the surface of the pile of toner without getting into the pile of toner significantly. This permits accurate detecting of the amount of toner 19 remaining in the stoner reservoir 20.

Figure 10A:
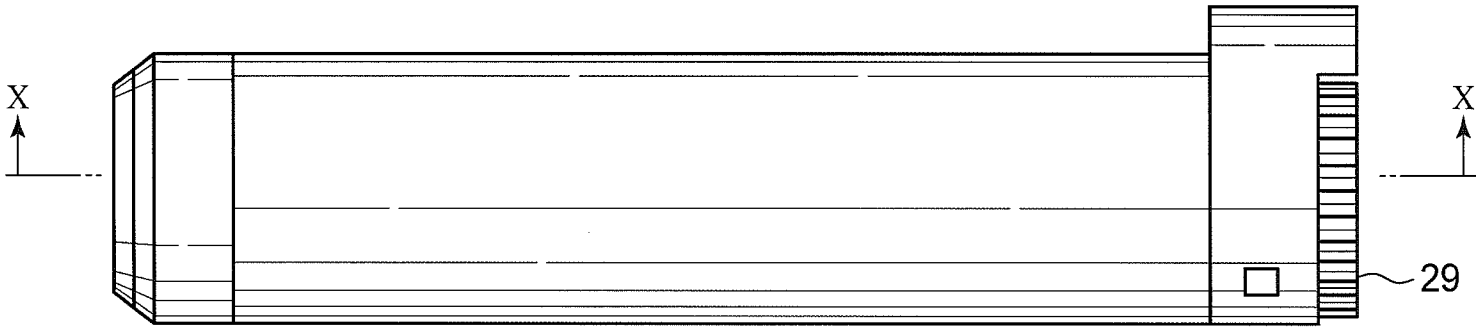
FIG. 10A is a perspective view illustrating a developer cartridge that incorporates the agitator according to the first embodiment.
Figure 10B:
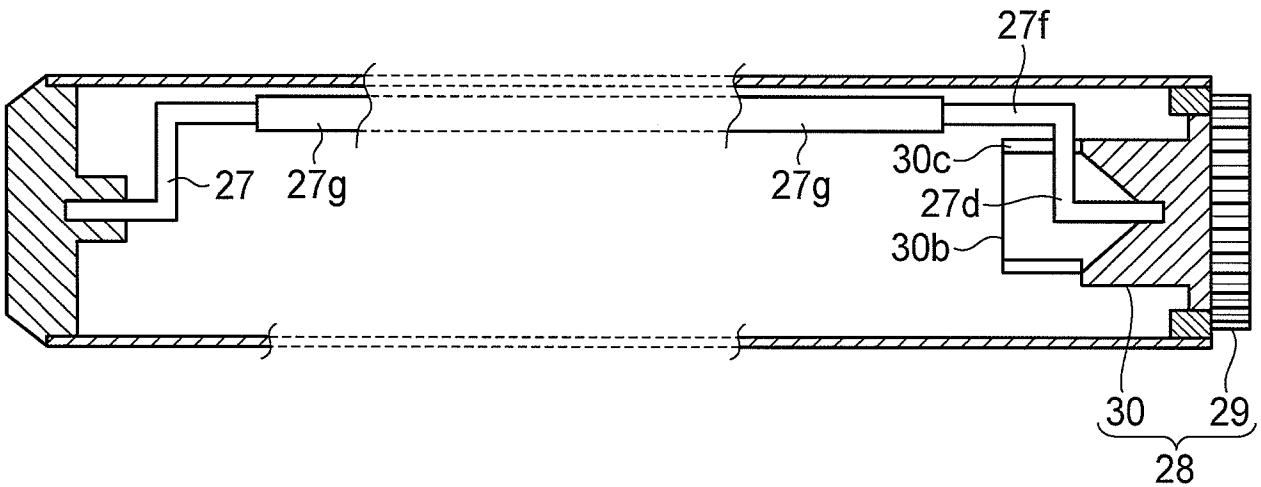
FIG. 10B is a partial cross-sectional view taken along a line X-X perspective view illustrating a developer cartridge that incorporates the agitator according to the first embodiment.

The aforementioned agitator may be applied to a developer cartridge for detachably attached to a developing unit of an image forming apparatus. FIG. 10A is a perspective view of such a developer cartridge and FIG. 10B is a partial cross-sectional view taken along a line X-X in FIG. 10A.

Second Embodiment

Figure 11:
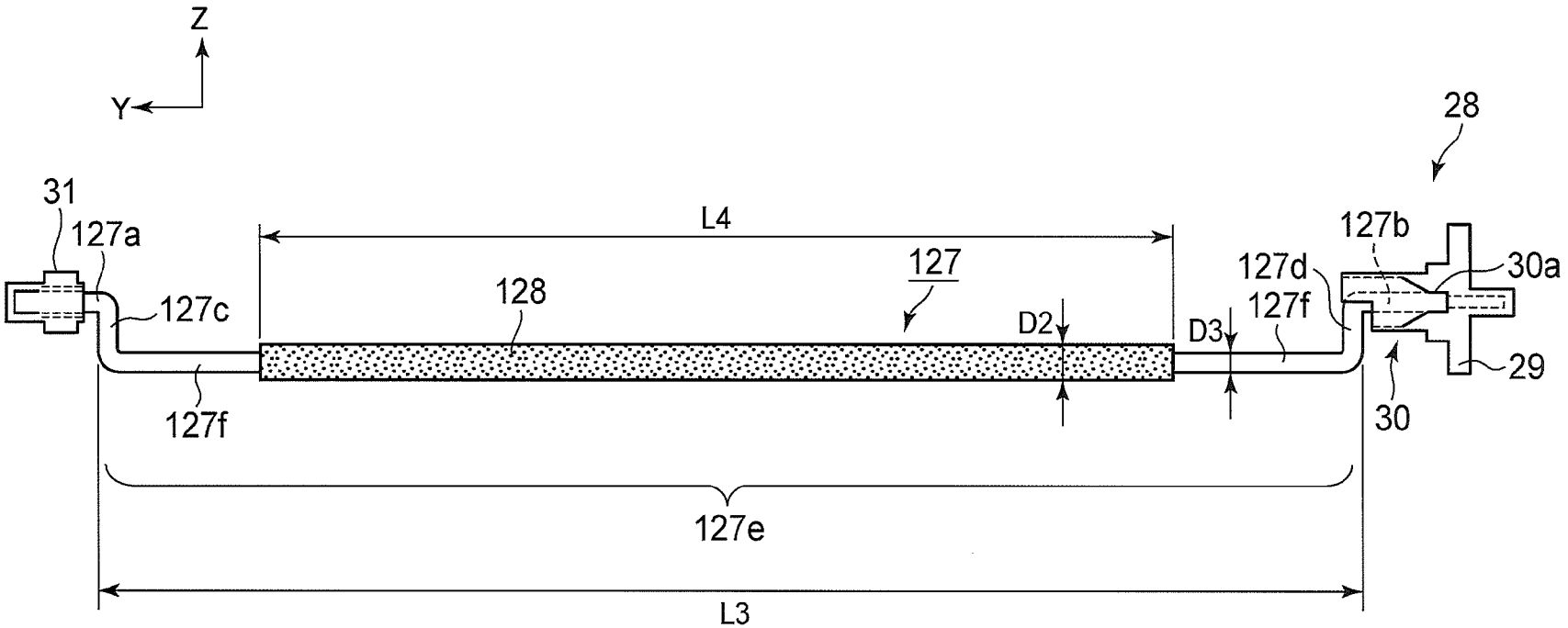
FIG. 11 illustrates an agitator, a bearing, and a drive gear.

FIG. 11 illustrates an agitator 127 and a bearing 31, and a drive gear 28.

The agitator 127 differs from the agitator 27 (FIG. 3) in that an agitating portion 127*e* is employed. Elements common to those of the first embodiment have been given the common reference characters and their description is omitted. Only those different from the first embodiment will be described explicitly. Pertinent portions of the developing unit according to the second embodiment have the substantially same configuration as the first embodiment shown in FIGS. 1 and 2 except for the agitator 127. Thus, a description will be given of the second embodiment with reference to FIGS. 1 and 2 as required.

Referring to FIG. 11, the agitator 127 is in the shape of a crank and is formed of an iron-based round bar. The agitator 127 includes shaft portions 127*a* and 127*b*, arm portions 127*c* and 127*d*, and a crank pin or agitating portion 127*e*. A rubber tube 128 is formed of a rubber material and fits over the agitating portion 127*e*. The agitating portion 127*e* agitates the toner when the agitator 127 is driven in rotation. The bearing 31, drive gear 28, agitator 127 of the second embodiment are related in the same way as the bearing 31, drive gear 28, and agitator 27 of the first embodiment, and their detailed description is omitted.

For example, the rubber tube 128 has a diameter D2 of 3.6 mm. The agitating portion 127*e* has a diameter D3 of 2.2 mm and a length L3 of 284 mm. The rubber tube 128 has a length L4 of 200 mm. The longitudinal mid point of the rubber tube 128 is substantially at the longitudinal mid point of the agitating portion 127*e*. The rubber tube 128 before it is assembled to the agitating portion 127*e* has an outer diameter of 3.6 mm and an inner diameter of 2.1 mm.

The rubber tube 128 is fitted over the agitator 127 before the agitator 127 is formed into a shape of a crank. The rubber tube 128 may have an inner diameter smaller than the diameter of the agitator 127. Alternatively, the rubber tube 128 may have an inner diameter larger than the diameter of the agitator if the positional relation between the agitating portion 127*e* and the rubber tube 128 is not primary importance, in which case the rubber tube 128 may be fitted over the agitating portion 128 without difficulty.

The rubber tube 128 may be formed of, for example, silicone rubber having a specific weight (about 1.2) smaller than that of the metal portion of the agitator 127 having a large specific weight (about 7.8), thereby implementing the agitator 127 having a large surface area to be in contact with the surface of the pile of toner without significantly increasing the overall weight. For example, the metal portion of the agitator 127 has a weight of 9.4 grams and the rubber tuber 128 has a weight of 1.6 grams.

With reference to FIGS. 12A-12C, a description will be given of the operation in which the toner level in the toner reservoir 20 (FIG. 2) is as high as the shaft 27*b* of the agitator 127.

The agitator 127 rotates such that when the agitating portion 127*e* rotates past the top dead center TDC as shown in FIG. 12A, the agitating portion 127*e* falls due to gravity, landing on the surface of the pile of the toner 19 (FIG. 12B). Although the agitating portion 127*e* hits the surface of the pile of the toner 19 due to its weight, a projected surface area of the rubber tube larger than that of the agitating portion 127*e* prevents the rubber tube 127*e* from entering deep into the pile of toner 19.

As the gear 28 rotates further, the side 30*c* of the drive gear 28 comes into contact with the arm 127*d* and then pushes the arm 127*d* so that the side 30*c* and the arm 127*d* rotate together until the agitating portion 127*e* again reaches the top dead center TDC. The aforementioned operation is repeated.

The method for detecting the amount of the toner 19 remaining in the toner reservoir 20 is the same as that performed in the first embodiment and a specific description thereof is omitted.

The dimensions including the diameter D2 of the rubber tuber 128, the overall length L3 of the agitating portion 127*e*, and the overall length L4 of the rubber tube 128 are only exemplary and may be changed experimentally in accordance with the fluidity of the toner and the shape of the toner reservoir 20.

As described above, when the agitator 27 falls by gravity from its top dead center TDC, the agitating portion 27*e* will land on the surface of the pile of toner without getting into the pile of toner significantly. This permits accurate detecting of the amount of toner 19 remaining in the stoner reservoir 20.

The present invention may be applied to printers, fax machines, copying machines, and multi-function printers capable of performing the functions of printer, copy machine, and fax machine. Although the first and second embodiments have been described in terms of a developing unit and a toner cartridge detachably attached to the developing unit, the developing unit and toner cartridge may be integral and the integrated structure of the developing unit and toner cartridge may be detachably attached to the image forming apparatus.

What is claimed is:

1. A developer holding apparatus for holding a developer material therein, comprising:

a chamber that holds the developer material; and a rotatable member disposed within the chamber, the rotatable member including a rotational shaft and an agitating portion that is offset from the rotational shaft and extends in a first direction parallel to the rotational shaft;

wherein the agitating portion includes a first portion and a second portion, the first portion including a first dimension in a second direction substantially perpendicular to the first direction and the second portion including a second dimension in a third direction substantially parallel to the second direction, the second dimension being smaller than the first dimension;

wherein the rotatable member includes a first specific weight and the first portion includes an additional member attached thereto, the additional member including a second specific weight smaller than the first specific weight; and wherein the additional member is a rubber tube.

2. A developer holding apparatus for holding a developer material therein, comprising:

a chamber that holds the developer material; and a rotatable member disposed within the chamber, the rotatable member being formed from a bar, the rotatable member including a rotational shaft and an agitating portion, the rotatable member being in the shape of a crank, the rotational shaft including end portions of the rotatable member, and the agitating portion being offset from the rotational shaft extending in a first direction parallel to the rotational shaft;

wherein the agitating portion includes a first portion and a second portion, the first portion including a crushed mid portion formed by crushing a substantially mid portion of the agitating portion, the crushed mid portion having a first dimension as a width of the crushed mid portion in a second direction that is substantially perpendicular to the first direction and extends radially outward from an axis of the rotational shaft, the second portion being a portion other than the first portion of the agitating portion, the second portion having a second dimension as a diameter of the bar, and the agitating portion being formed so that the first dimension is larger than the second dimension.

3. The developer holding apparatus according to claim 2, wherein the first portion is in the shape of a flat plate.

4. The developer holding apparatus according to claim 3, wherein the first portion and the second portion are in a single piece construction.

5. The developer holding apparatus according to claim 2, wherein the second portion is in the shape of a round bar.

6. The developer holding apparatus according to claim 2, wherein the rotatable member includes a first specific weight and the first portion includes an additional member attached thereto, the additional member including a second specific weight smaller than the first specific weight.

7. The developer holding apparatus according to claim 2, further comprising a drive member that drives the rotatable member to rotate about the rotational shaft, wherein when the developer holding apparatus is oriented so that the rotational shaft extends substantially horizontally, if the drive member rotates, the drive member abuts the rotatable member and drives the rotatable member to rotate together with the drive member until the agitating portion rotates past a top dead center thereof and then allows the rotatable member to rotate about the rotational shaft due to free fall so that the agitating portion lands on a surface of a pile of the developer material.

8. The developer holding apparatus according to claim 7, wherein the drive member supports the rotatable member rotatably, wherein when the drive member rotates, the drive member pushes a part of the rotatable member causing the rotatable member to rotate.

9. The developer holding apparatus according to claim 7, wherein the drive member transmits rotational force to the rotatable member by a one-way clutch.

10. A developing unit incorporating the developer holding apparatus according to claim 2.

11. An image forming apparatus incorporating the developer holding apparatus according to claim 2.

12. The developer holding apparatus according to claim 2, wherein when the rotational member rotates about the rotational shaft, the first portion as the crushed mid portion moves without contact with an inner surface of the chamber.

* * * * *